US006256914B1

(12) United States Patent
Yeh

(10) Patent No.: US 6,256,914 B1
(45) Date of Patent: Jul. 10, 2001

(54) TRANSPARENT CUBE HAVING PICTURE DISPLAYING FUNCTION

(76) Inventor: Sy-Ying Yeh, P.O. Box 82-144, Taipei (TW)

( * ) Notice: Subject to any disclaimer, the term of this patent is extended or adjusted under 35 U.S.C. 154(b) by 0 days.

(21) Appl. No.: 09/398,051

(22) Filed: Sep. 17, 1999

(51) Int. Cl.[7] ..... A47G 1/06
(52) U.S. Cl. ..... 40/720; 40/711
(58) Field of Search ..... 40/720, 711, 503, 40/504, 506; 220/602, 662, 665

(56) References Cited

U.S. PATENT DOCUMENTS 1,260,912 * 3/1918 Kisch ..... 220/665
3,456,374 * 7/1969 Baermann ..... 40/711
3,561,146 * 2/1971 Dembar ..... 40/720
3,577,666 * 5/1971 Wexler ..... 40/720
3,645,025 * 2/1972 Giesecke ..... 220/662 X
3,703,045 * 11/1972 Nyman ..... 40/720
3,774,332 * 11/1973 Schneider ..... 40/720
4,047,633 * 9/1977 Trombly ..... 220/665 X
4,261,122 * 4/1981 LeVine ..... 40/711
4,402,397 * 9/1983 Spence ..... 220/665 X
5,502,907 * 4/1996 Wang ..... 40/711

* cited by examiner

*Primary Examiner*—Joanne Silbermann
(74) *Attorney, Agent, or Firm*—A & J

(57) ABSTRACT

A transparent cube with picture displaying function comprising a transparent body and a plurality of transparent boards surrounded the transparent body, characterized in that the four side walls of the transparent body are provided with at least two small holes containing small magnet therein, and the inner side wall of the four transparent boards are provided with at least two small holes corresponding to the small holes of the transparent body and also containing a small magnet therein; when the transparent body contacts with the four transparent boards face to face, the transparent body is firmly secured together with the four transparent boards as a result of attraction force between the small magnets, and a picture (or photograph) is inserted in between the contact face of the transparent body and the four transparent boards such that the transparent cube can provides four displayed pictures for appreciation.

7 Claims, 12 Drawing Sheets

TRANSPARENT CUBE HAVING PICTURE DISPLAYING FUNCTION

BACKGROUND OF THE INVENTION a) Technical Field of the Invention

The present invention relates to a transparent cube, and in particular, relates to a cuboid module which can be functioned as frame for picture and photographs, or used as decorative item, paper-press, coin container, pencil holder, or box for stationery.

b) Description of the Prior Art

It is very common that picture frame mounted with pictures is placed at a significant location to provide appreciation of the picture, or is used as a decoration. However, a common picture frame can only display one photograph or picture and it also occupies a larger space. Besides, when the picture frame is to be placed in vertical, the back of the frame has to be mounted with a support to stabilize the picture frame. Thus, the picture frame does not provide a good stability and it can be easily toppled and the glass panel may be broken. Thus it is an aim of the inventor to overcome the drawback of the conventional picture frame.

SUMMARY OF THE INVENTION

The main object of the present invention is to provide a transparent cube having picture displaying function, comprising a transparent body including two (a top and a bottom) rectangular blocks, and four transparent boards being fixed onto the surrounding of the transparent body, wherein at the contact face of the rectangular blocks and the transparent boards, a plurality of small holes are provided for the mounting of small magnets, and when the rectangular blocks contact with each other, or the rectangular blocks are in contact with the transparent boards, a transparent cube is formed by means of the attraction force of the magnets. Pictures can be inserted in between the contact face of the rectangular blocks, and in between the contact face of the rectangular block with the transparent board. As the cube is transparent, the pictures thus mounted can be clearly seen.

Another object of the present invention is to provide a transparent cube having picture displaying function, wherein the contact faces between the rectangular blocks, and that between the rectangular block with the transparent board are rigidly combined, and therefore they will not drop from the cube.

Another object of the present invention is to provide a transparent cube having picture displaying function, wherein the cube is made from transparent acrylic materials to allow the pictures to be seen.

The advantages of the preferred embodiment of the present invention as follows:

(a) A maximum of three pictures mounted onto the transparent cube can be seen at a time from different viewing angle.

(b) The cube is impressive and provides an aesthetic appearance as a decorative item.

(c) The cube is rigid and stable, it can be easily dismantled and installed. Thus, it can be easily used.

(d) The cube also functions as a paper press, stationery box or pencil holder.

(e) The cube can also be used to display coins.

(d) The cube can also be used as a coin container.

The various features of novelty which characterized the invention are pointed out with particularity in the claims annexed to and forming a part of this disclosure.

BRIEF DESCRIPTION OF THE DRAWINGS

The above set forth and other features of the invention are made more apparent in the Detailed Description of the invention when read in conjunction with the attached drawings, wherein.

DETAILED DESCRIPTION OF THIE PRESENT INVENTION

Figure 1:
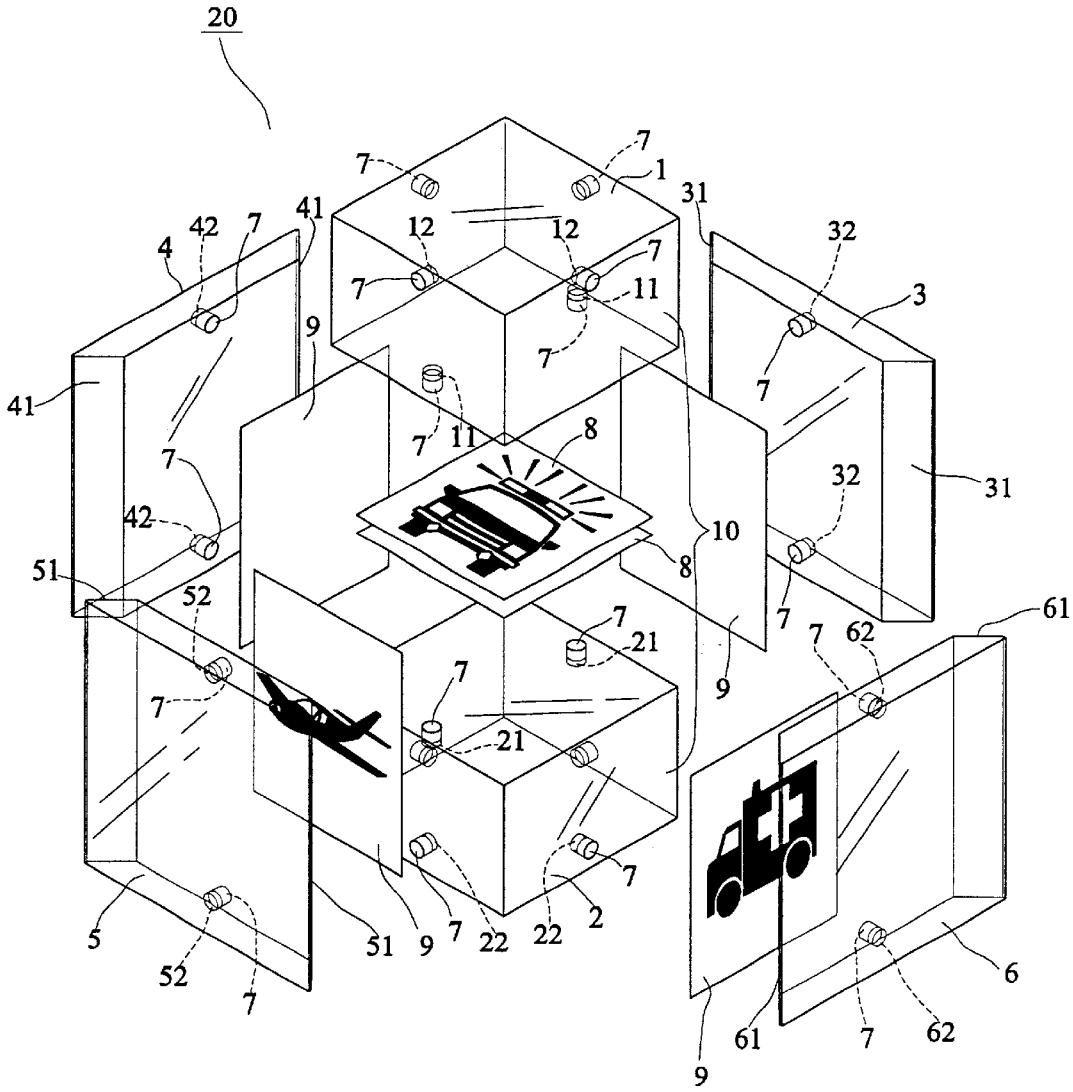
FIG. 1 is a perspective exploded view of the transparent cube in accordance with the present invention.

Reference is made to FIG. 1 for illustrating the exploded view of a transparent cube 20 comprising a transparent body 10 formed from two transparent rectangular blocks 1, 2, and four transparent boards 3~6 fixed around the slides of the transparent body 10.

Figure 2:
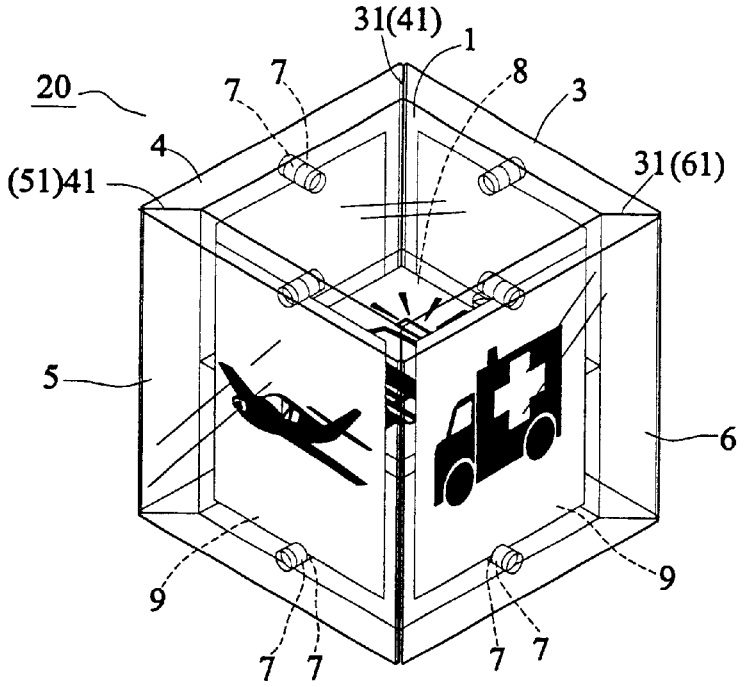
FIG. 2 is a perspective view of a combined transparent cube of FIG. 1.

Referring to FIG. 2, there is shown a perspective view of the transparent cube 20 in accordance with the present invention. The transparent body 10 is provided at the center thereof and the four transparent boards 3~6 are respectively fixed at the surrounding of the body 10, such that the two lateral edges of the individual transparent boards 3~6 are rigidly fixed, and the two lateral edges of the boards 3~6 can be made into a 45° angle, which form a cube.

Figure 3:
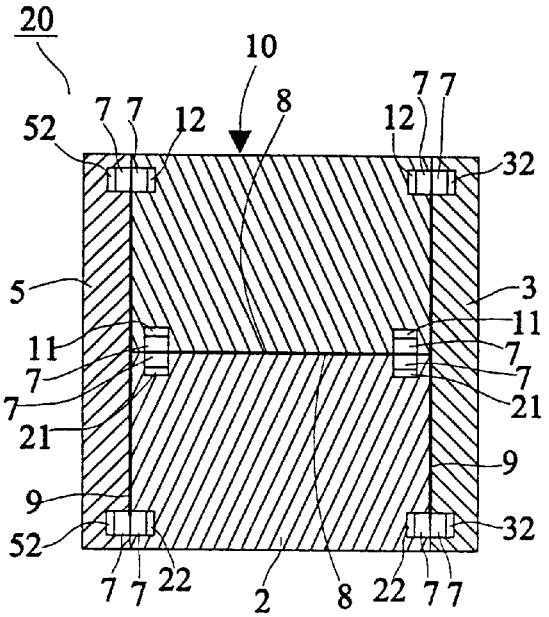
FIG. 3 is a sectional view of the transparent cube of FIG. 1.

In accordance with the present invention, the transparent body 10 is formed from two similar shapes rectangular blocks 1, 2, which stacked on each other (a top and a bottom rectangular block) or two rectangular blocks formed into a square. When two rectangular blocks 1, 2 are used, their contact faces are provided with a plurality of corresponding aligned small holes 11, 21 (at least two small holes) containing a small magnet 7. When the top and bottom rectangular blocks 1, 2 are in contact and face to face, the magnets 7 attract to each other and thus firmly secured, which is shown in FIG. 3.

Next, the four side walls of the rectangular blocks 1, 2 are provided with at least a small hole 12, 22 containing a magnet 7. The inner walls of the four transparent boards 3~6 also provide with at least two small holes 32~62 correspondingly aligned with the small holes 12, 22, and also containing a magnet 7. When the transparent body 10 contacts with the four transparent boards 3~6 face to face, the magnets 7 attract to each other, and the transparent body 10 and the four transparent boards 3~6 are firmly secured, as shown in FIGS. 2 and 3.

In between the rectangular block 1 and the rectangular block 2, two positive side and reverse side stacked pictures (or photographs) are provided, and in between the surrounding walls of the transparent body 10 and the transparent boards 3~6, a picture 9 (or photograph) is placed therebetween.

After the cube 20 has been firmly combined, the picture 8 or 9 can be seen from different angles of the transparent cube. Thus, the transparent block 20 provides a visual effect of six pictures.

If the transparent body 10 is formed as a unit (integrally formed from two rectangular blocks), then, the transparent cube 20 provides a visual effect of 4 pictures.

Figure 4:
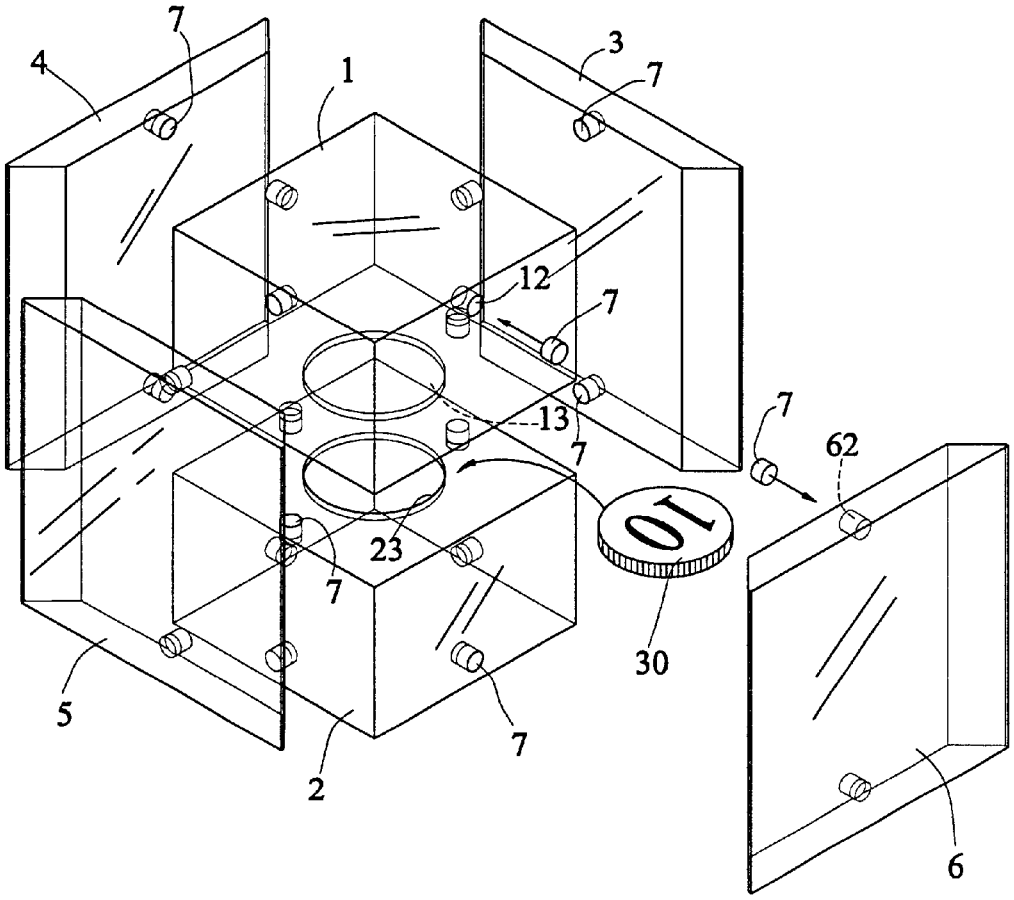
FIG. 4 is a perspective exploded view of another preferred embodiment of a transparent cube in accordance with the present invention.
Figure 5:
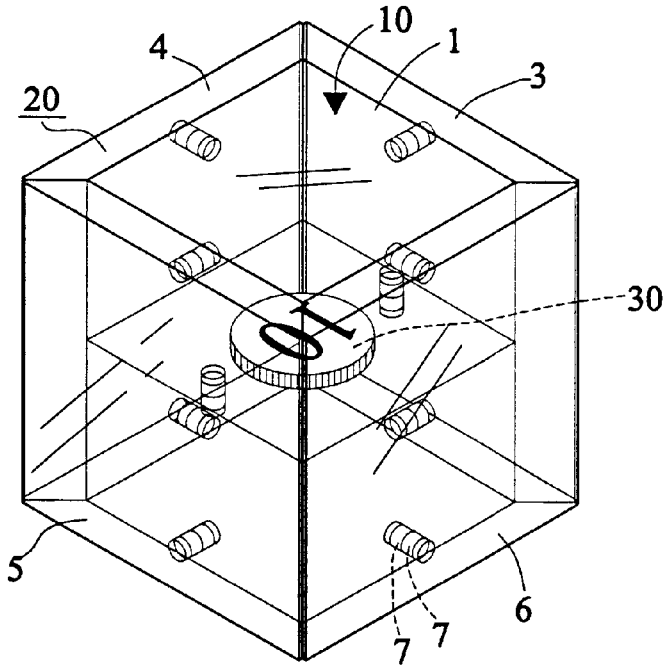
FIG. 5 is a perspective view of the transparent cube of FIG. 4 of the present invention.
Figure 6:
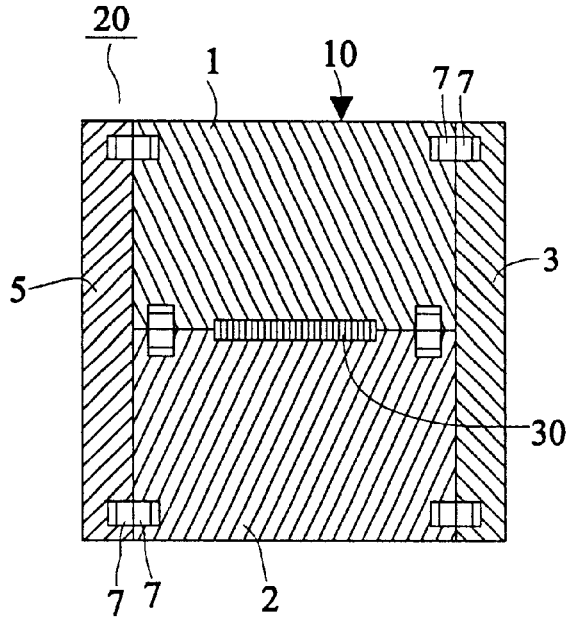
FIG. 6 is a sectional view of the transparent cube of FIG. 4 of the present invention.

FIG. 4 illustrates a perspective exploded view of another transparent cube. This figure is exactly similar to FIG. 1 except that the contact face of the rectangular block 1 and rectangular block 2 are respectively provided with corresponding aligned shallow slots 13, 23. Before the two shallow slots 13, 23 are closed, one or two coins 30 can be mounted. After the cube 20 is completed, as shown in FIGS. 5 and 6, it provides a visual effect. In view of the present preferred embodiment, four pictures 9 and one or two coins 30 visual effect are displayed.

Figure 7:
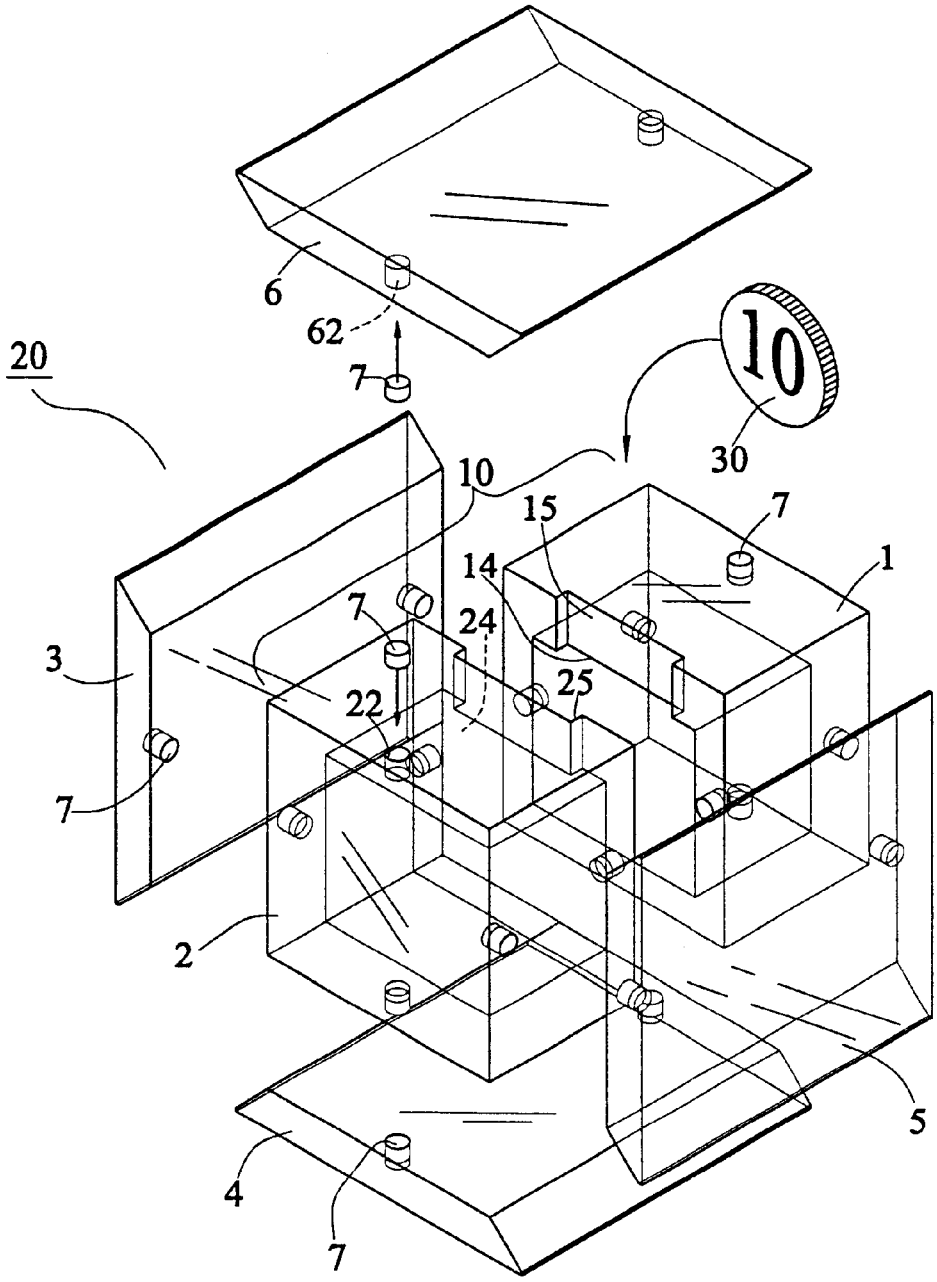
FIG. 7 is a perspective exploded view of another preferred embodiment of the transparent cube of the present invention.
Figure 8:
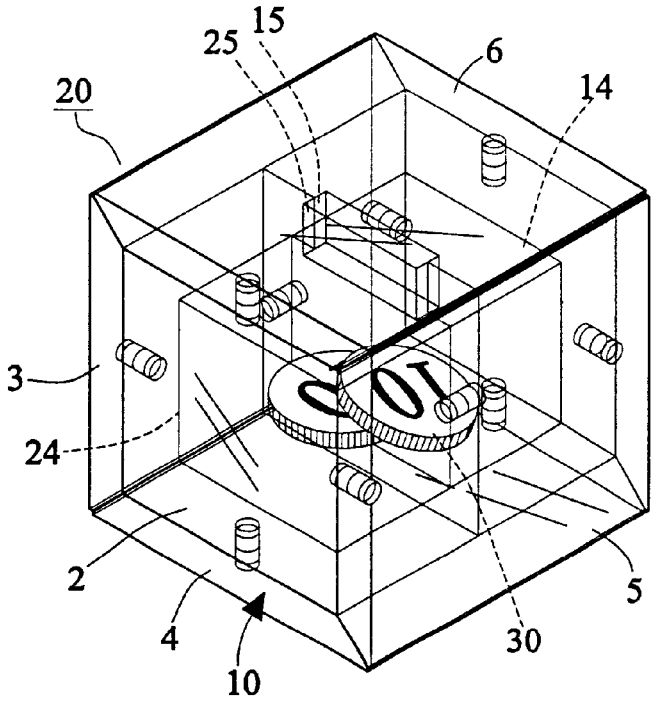
FIG. 8 is a perspective view of the transparent cube of FIG. 7 of the present invention.
Figure 9:
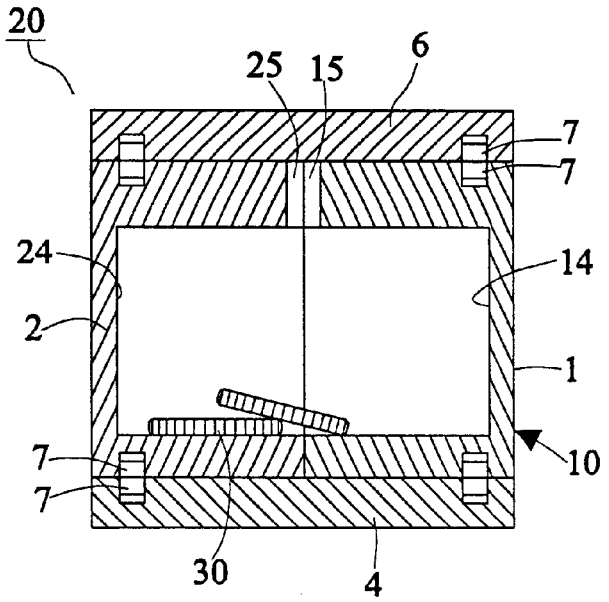
FIG. 9 is a sectional view of the transparent cube of FIG. 7 of the present invention.

FIG. 7 is a perspective exploded view of another preferred embodiment. This figure is exactly similar to FIG. 1 except that the rectangular blocks 1, 2 are combined from left to right, and the contact faces therefore are respectively provided with corresponding aligned storage slots 14, 24 having a notch 15, 25 at the top thereof. FIGS. 8 and 9 illustrates the transparent cube 20 after completion. At this instance, the coin 30 can be inserted via the notches 15, 25 of the transparent body 10, and one of the boards 3~6 is used to cover the notches 15, 25. That is, the coin 30 will not drop from the notches 15, 25. Thus, the transparent cube 20 provides a dual visual display of pictures appreciation and as a coin container for money saving.

Figure 10:
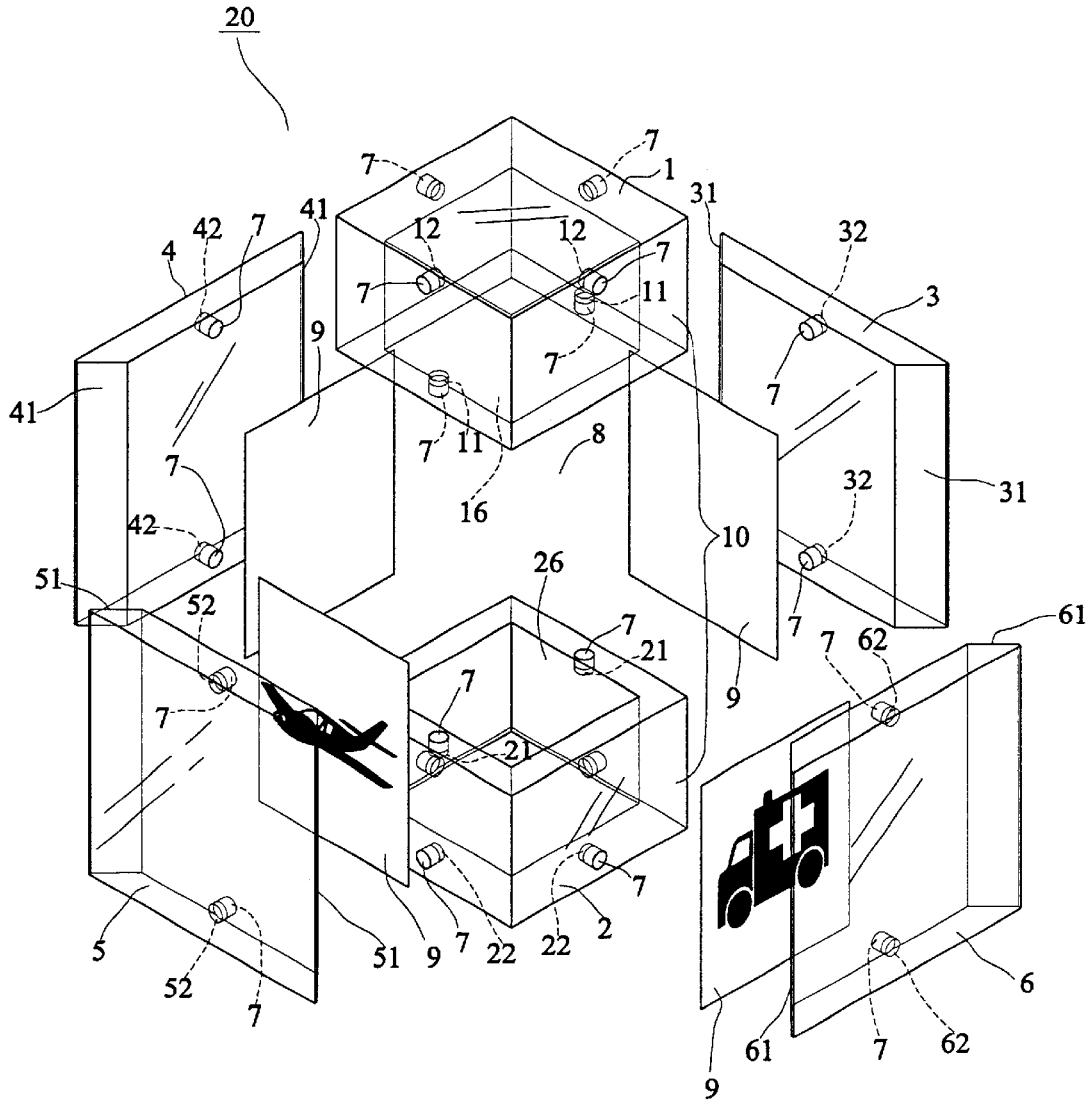
FIG. 10 is a perspective exploded view of another transparent cube in accordance with the present invention.
Figure 11:
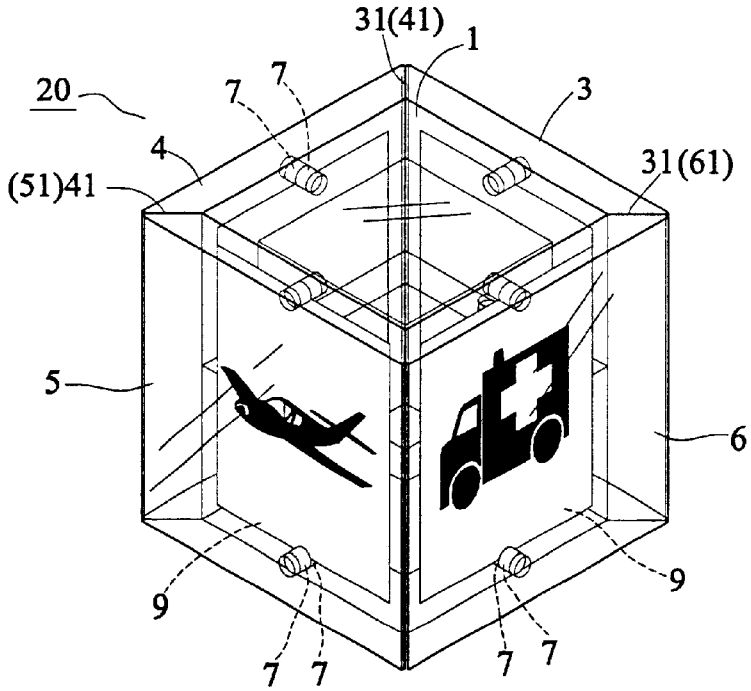
FIG. 11. is a perspective view of the transparent cube of FIG. 10 of the present invention.
Figure 12:
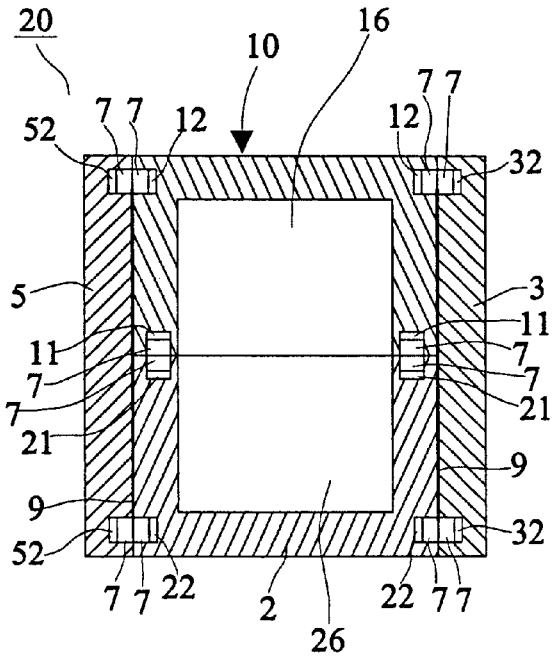
FIG. 12 is a sectional view of the transparent cube of FIG. 10 of the present invention.

FIG. 10 is a perspective exploded view of another transparent cube. This figure is exactly similar to FIG. 1 except that the contact faces of the rectangular blocks 1, 2 are respectively provided with a recess which can be aligned and combined together. The surrounding of the transparent body 10 can be mounted with four pictures 9 for appreciation.

Figure 13:
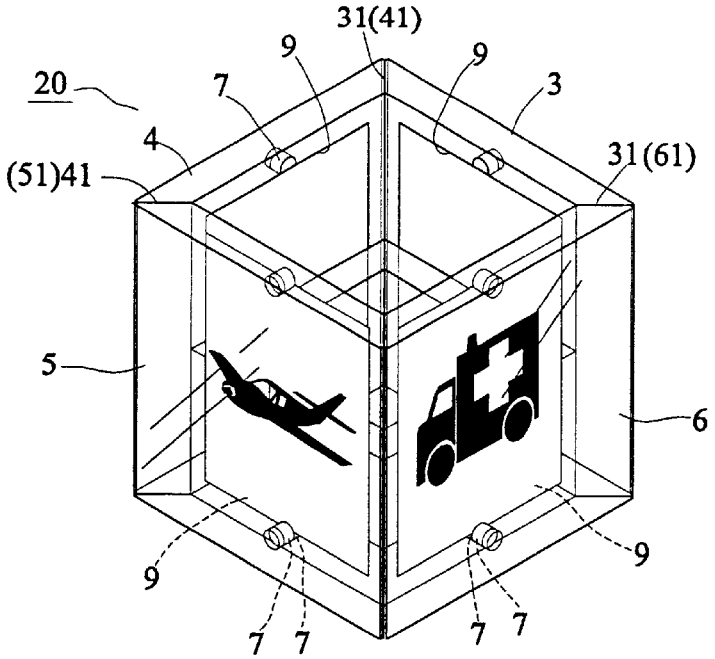
FIG. 13 is a perspective view of FIG. 10, wherein the top rectangular block is taken out from the transparent cube in accordance with the present invention.
Figure 14:
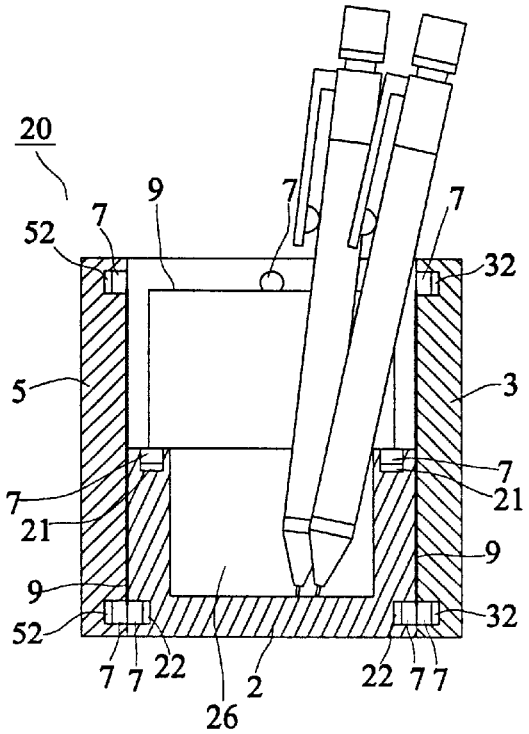
FIG. 14 is a sectional view of the transparent cube of FIG. 10, wherein the top rectangular block is lifted in accordance with the present invention.

If the top rectangular block 1 is removed, and the bottom rectangular block 2 is retained at the transparent cube 20, the transparent cube 20 has a configuration as shown in FIG. 13. At this instance, the transparent cube 20 is used as a pencil holder (as shown in 14) or a box.

Figure 15:
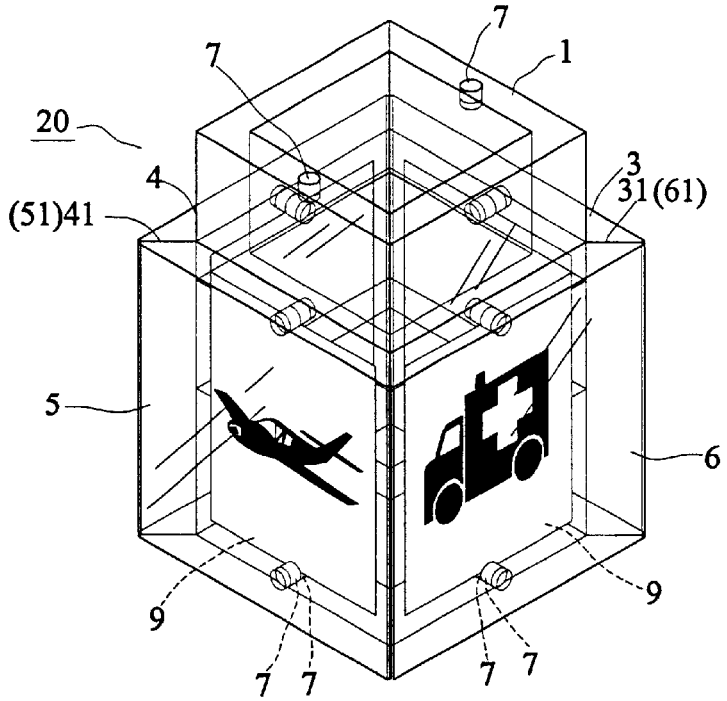
FIG. 15 is a perspective view of the transparent cube of FIG. 10 of the present invention.
Figure 16:
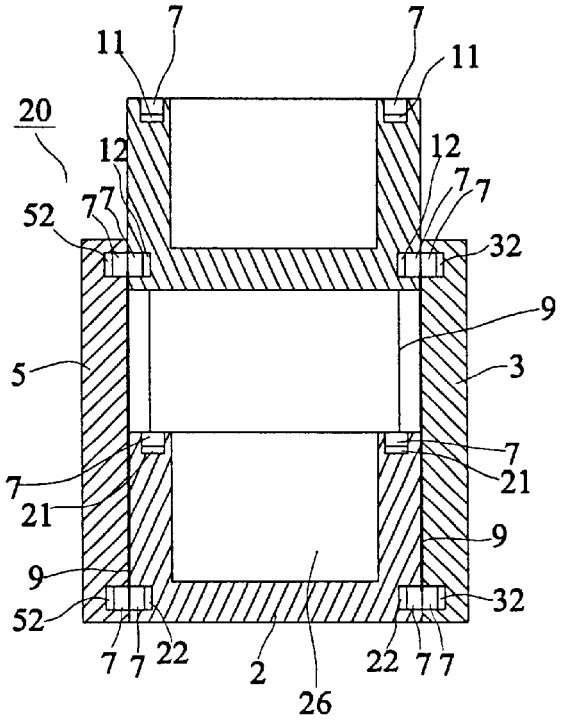
FIG. 16 is a sectional view of the transparent cube of FIG. 15 of the present invention.

In accordance with the present invention, the top rectangular block 1 can be lifted (as shown in FIG. 15), and as a result of the attraction of the magnet 7 surrounded the rectangular block 1 and the magnets 7 contained within the four transparent boards 3~6, the transparent boards 3~6 are suspended as shown in FIG. 16. At this instance, the rectangular block 1 can be used as a container for keeping small stationery items, and the surrounding of the transparent body 10 can clip with four pictures 9 for appreciation.

Figure 17:
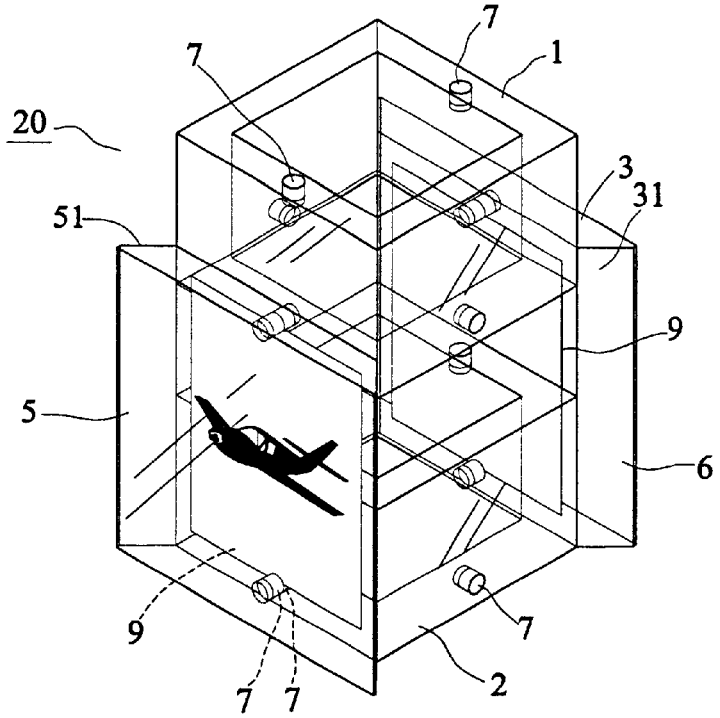
FIG. 17 is a perspective view of the transparent cube of FIG. 15, wherein the two transparent boards are removed.
Figure 18:
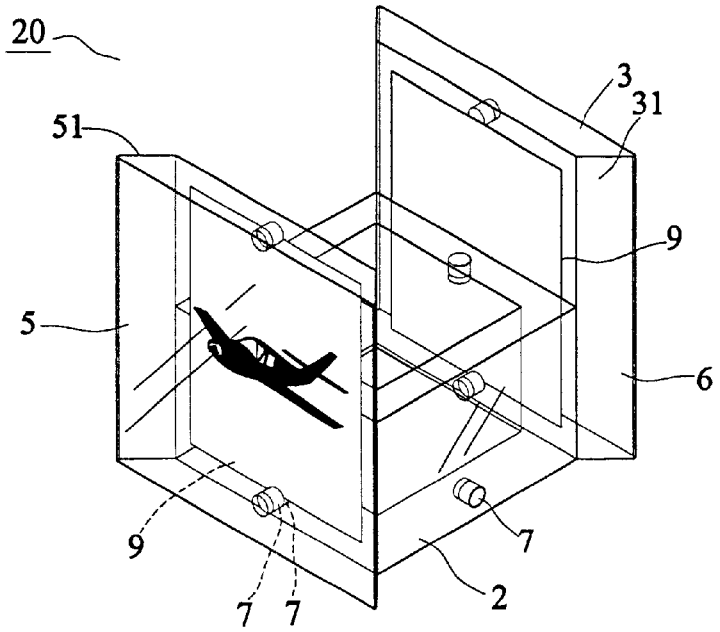
FIG. 18 is a perspective view of the transparent cube of FIG. 17, wherein the top rectangular block is removed.

In the above said transparent cube 20, if two of the four transparent boards 4, 6 (or 3, 5) are removed (as shown in FIG. 17,) the suspended configuration of the top rectangular block 1 can be clearly seen. If the top rectangular block 1 is removed (as shown in FIG. 18), the transparent cube 20 can be used as a simple box.

Figure 19:
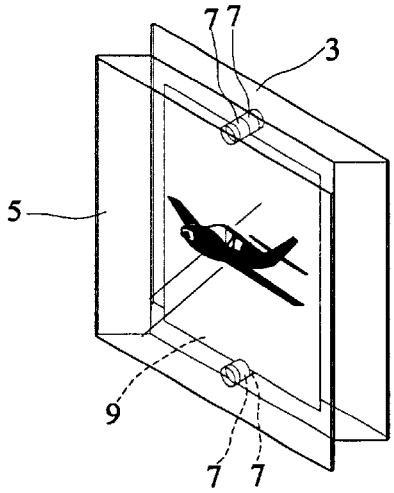
FIG. 19 is another preferred embodiment having two transparent boards combined together and with a picture in accordance with the present invention.
Figure 20:
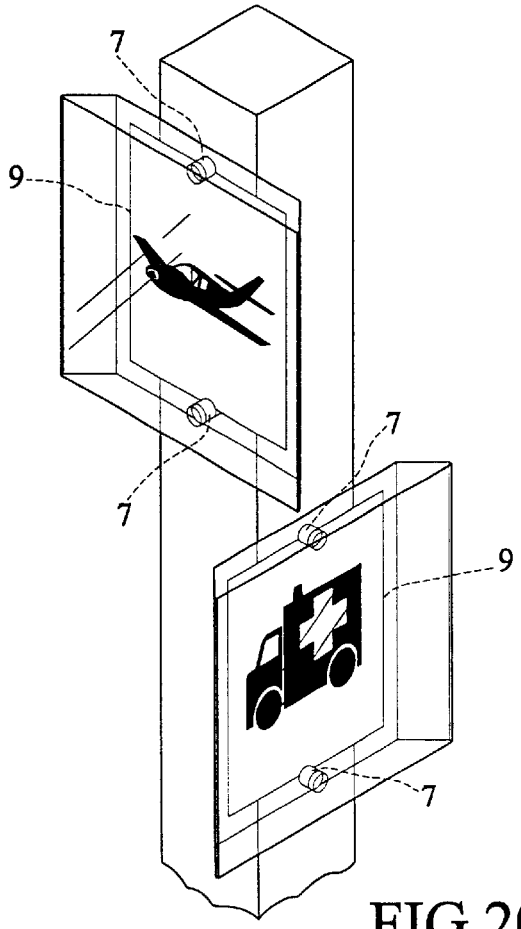
FIG. 20 is another preferred embodiment having a transparent board together with pictures in accordance with the present invention.

In accordance with the present invention, the transparent boards 3~6 can be mounted in couple so as to clip a picture 9 (as shown in FIG. 19) and to form a simple picture frame which can be placed on a table. In addition, a single piece of the transparent boards 3~6 can also be used to clip the picture 9 and adheres onto an iron bar (as shown in FIG. 20) or iron plate to form a simple picture frame.

While specific embodiments of the invention have been shown and described in detail to illustrate the present invention, it will be understood that the invention may be embodied otherwise without departing from the principle of the present invention.

I claim:

1. A transparent cube with picture displaying function comprising a transparent body and a plurality of transparent boards surrounded the transparent body, characterized in that the four side walls of the transparent body are provided with at least two small holes containing small magnet therein, and the inner side wall of the four transparent boards are provided with at least two small holes corresponding and aligned to the small holes of the transparent body and also containing a small magnet therein; when the transparent body contacts with the four transparent boards face to face, the transparent body is firmly secured together with the four transparent boards as a result of attraction force between the small magnets, and a picture (or photograph) is inserted in between the contact face of the transparent body and the four transparent boards such that the transparent cube can provides four displayed pictures for appreciation, wherein the transparent body is constituted from two (top and bottom) rectangular blocks stacked together and a plurality of aligned small holes are provided to the contact face of the two rectangular blocks, the small holes containing a small magnet therein, such that when the top and bottom rectangular blocks contact and in face to face, the two blocks are firmly secured by the attraction force of the small magnet, and a positive side picture and a reverse side picture are mounted in between the contact face of the two rectangular blocks to provide six displayed pictures.

2. The transparent cube as set forth in claim 1, wherein the two rectangular block contact faces of the transparent body are respectively provided with corresponding aligned shallow slots, and a coin is placed prior to the closing of the shallow slots so that the cube is used to display coins for appreciation.

3. The transparent cube as set forth in claim 1, wherein the two rectangular block contact faces of the transparent body are respectively provided with storage slots having a notch on the top thereof, and the notch is covered by one of the blocks, thereby the cube provides picture displaying and coin displaying for appreciation.

4. The transparent cube as set forth in claim 1, wherein the two rectangular blocks of the transparent body are individually provided with a recess such that each recess on the blocks is correspondingly aligned with each other.

5. The transparent cube as set forth in claim 4, wherein the top rectangular block is removable and the bottom rectangular block is retained and in combination with the four transparent boards.

6. The transparent cube as set forth in claim 4, wherein the top rectangular block is adhered onto the top of the four transparent boards.

7. The transparent cube as set forth in claim 4, wherein one or two of the four transparent boards is/are removable from the cube.

* * * * *